United States Patent [19]

Pedersen

[11] 4,214,580

[45] Jul. 29, 1980

[54] BREATHING APPARATUS

[75] Inventor: Vernon G. Pedersen, Chicago, Ill.

[73] Assignee: Dacor Corporation, Northfield, Ill.

[21] Appl. No.: 901,456

[22] Filed: May 1, 1978

[51] Int. Cl.[2] ..... B63C 11/22; A62B 7/04

[52] U.S. Cl. ..... 128/204.26; 137/494; 137/DIG. 9; 128/205.24

[58] Field of Search ..... 128/142.2, 142 R, 147, 128/210, 209; 137/494, DIG. 9, DIG. 8

[56] References Cited

U.S. PATENT DOCUMENTS

| | | | |
|---|---|---|---|
| 2,893,386 | 7/1959 | Sajeck | 128/147 X |
| 3,633,611 | 1/1972 | MacNiel | 137/494 |
| 4,041,977 | 8/1977 | Matsuno | 128/142.2 X |
| 4,041,978 | 8/1977 | Leemann | 128/142.2 X |
| 4,094,314 | 6/1978 | Le Cornec | 128/142.2 |
| 4,140,112 | 2/1979 | Kobzan | 128/142.2 |

*Primary Examiner*—Henry J. Recla

*Attorney, Agent, or Firm*—Edmond T. Patnaude

[57] ABSTRACT

The venturi action in a demand regulator is controlled by moving a baffle across an air inlet into the regulator chamber as the inlet valve is opened.

9 Claims, 9 Drawing Figures

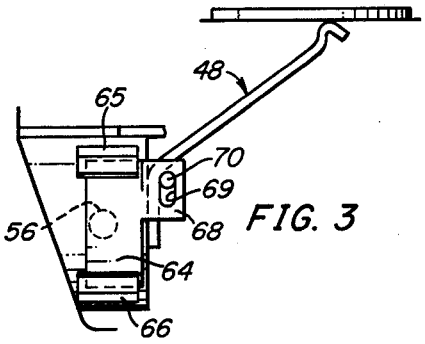
FIG. 3
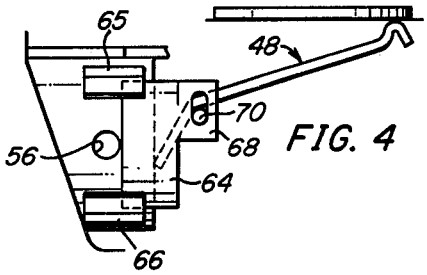
FIG. 4
FIG. 5
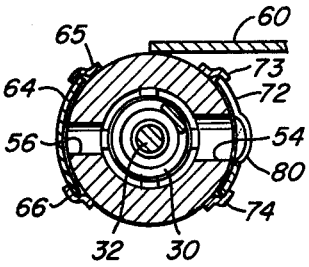
FIG. 6
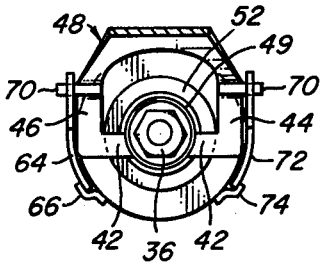
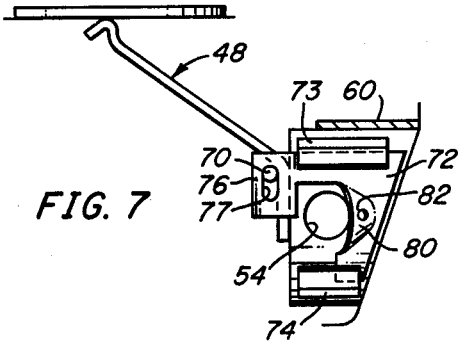
FIG. 7
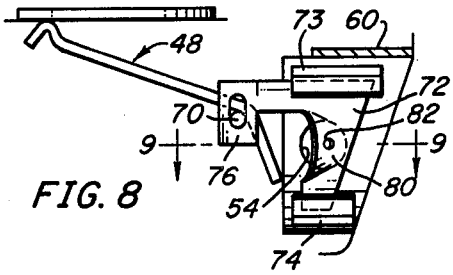
FIG. 8
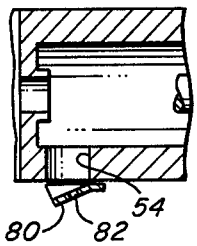
FIG. 9

BREATHING APPARATUS

The present invention relates in general to pressure regulation in self contained breathing systems such as used, for example, in SCUBA diving, and it relates more particularly to a new and improved method and means for improving the breathing characteristics of a demand type regulator by automatically reducing the venturi action in the regulator as the rate of air flow through the regulator increases.

BACKGROUND OF THE INVENTION

In my earlier filed copending application Ser. No. 830,588 filed Sept. 6, 1977 now U.S. Pat. No. 4,140,113, there is disclosed a novel method and apparatus for controlling the venturi action in a demand type regulator. The present invention is directed to a new and improved method and apparatus for adapting my earlier invention to a different type of demand regulator.

Pressure regulators such as those used in underwater breathing apparatus commonly employ the pressure differential between the ambient and a breathing chamber in the regulator to operate an air valve which supplies air to the breathing chamber. This is accomplished by mounting a flexible diaphragm across an opening in the wall of the breathing chamber and using the diaphragm to actuate the air valve. Since the mouthpiece is connected to the breathing chamber the driver breaths from the breathing chamber. In single hose regulators the diver also exhales through the breathing chamber to the ambient while in double hose regulators the exhaled gases go directly to the ambient.

When the diver commences to inhale while the air inlet valve is closed, the pressure in the breathing chamber is reduced causing the diaphragm to be sucked into the breathing chamber and thereby to open the air inlet valve. When the user exhales, the pressure in the breathing chamber increases to cause the diaphragm to move out and thereby to close the air inlet valve. In order to reduce the effort required to breath from such regulators it is common practice to design the regulator so that a portion of the inlet air travels as a jet or stream into the mouthpiece tube, thereby to provide a so-calledventuri effect which educts air from the breathing chamber and thus tends to reduce the pressure in the breathing chamber. Consequently, the diaphragm is held in the pulled-in position by the venturi action and in turn holds the air inlet valve open. While such a venturi effect makes it easier for the user to inhale from the regulator, exhaling becomes more difficult inasmuch as the venturi action must be overcome before the air inlet valve can be closed. Accordingly, the amount of venturi action provided must be carefully adjusted for optimum inhalation and exhalation.

In the prior art regulators the amount of venturi action is at a maximum when the air inlet valve is fully open that exhalation ordinarily occurs. On the other hand, the need for the venturi action is greatest when inhalation commences and the air inlet valve begins to open. Yet the air flow rate is low at this time wherefor the venturi action is also low.

SUMMARY OF THE INVENTION

Briefly, there is provided in accordance with the teachings of the present invention a novel breathing regulator including inter alia a housing having a recess therein, a diaphragm mounted across said recess to define a chamber in said housing, a breathing port opening through said housing into said chamber, an air inlet valve mounted to said housing and having an air inlet for connection to said source of compressed air and an air outlet port disposed to direct a stream of air from said outlet port into said breathing port thereby to develop a venturi action in said regulator by educting air from said chamber, a valve element in said air valve movable between a fully open position and a fully closed position, actuator means connected between said valve element and said diaphragm for moving said valve element between said fully closed and said fully open positions in response to the movement of said diaphragm, baffle or auxiliary valve mounted for sliding movement across said outlet port, and means connecting said baffle or auxiliary valve means to said actuator means whereby said baffle or auxiliary valve means is moved over said port as said valve element is moved toward said fully open position.

In accordance with another aspect of the present invention, the venturi action in a breathing regulator is controlled by increasing the size of an air inlet port which opens directly into the breathing chamber to prevent the air flow to the breathing tube from another air inlet port from increasing as the pressure in the breathing chamber drops.

GENERAL DESCRIPTION OF THE DRAWINGS

The present invention will be better understood by a reading of the following detailed description taken in connection with the accompanying drawings wherein:

FIG. 3 is a side elevational view showing a portion of the regulator of FIG. 1 with the air inlet valve in the closed position;

FIG. 4 is a view similar to that of FIG. 3 with the air inlet valve in the open position;

FIG. 5 is a cross-sectional view taken along the line 5—5 of FIG. 1;

FIG. 6 is a side elevational view taken from the side opposite that of FIG. 3 with the air inlet valve in the closed position;

FIG. 7 is a view similar to that of FIG. 6 with the air inlet valve in the open position;

FIG. 8 is a cross-sectional view taken along the line 8—8 in FIG. 7; and FIG. 9 is a cross-sectional view taken along the line 9—9 in FIG. 8.

DETAILED DESCRIPTION OF THE INVENTION

Figure 1:
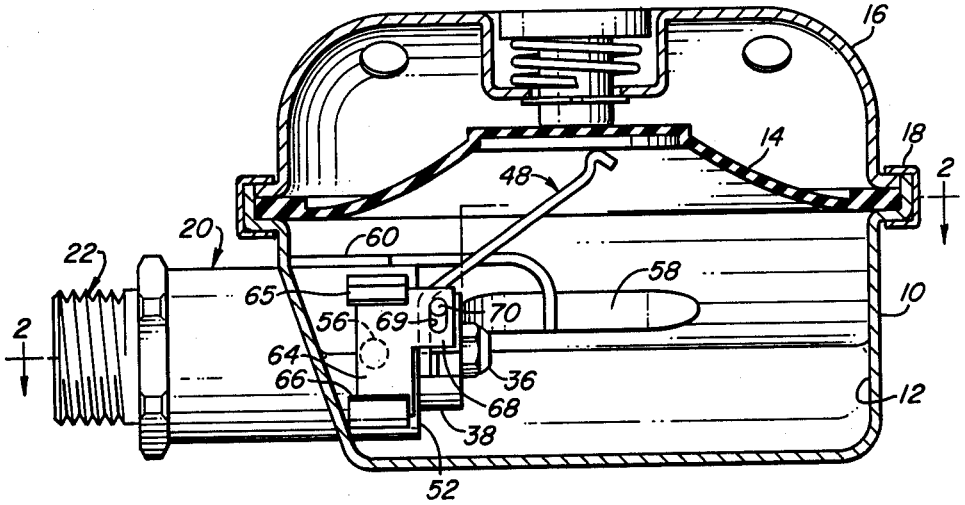
FIG. 1 is a cross-sectional view of a breathing regulator embodying the present invention.
Figure 2:
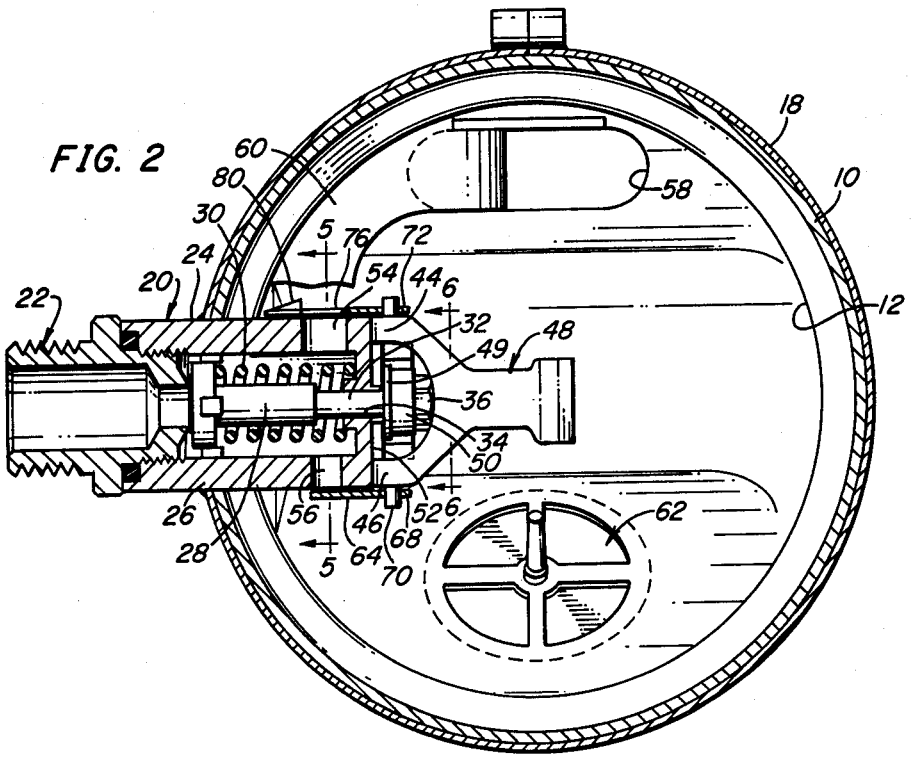
FIG. 2 is a cross-sectional view taken along the line 2—2 of FIG. 1.

Referring now to the drawings and particulary to FIGS. 1 and 2 thereof, a demand type breathing regulator of a type used by SCUBA divers includes a cup-like housing member 10 having a recess 12 therein. A flexible diaphragm 14 is positioned across the top of the recess 12 and is sealed to the rim of the housing by a perforate cover 16 and an annular channel-shaped clamp 18. The diaphragm 14 and the housing 10 thus define a breathing chamber which is sealed from the ambient.

An air inlet valve 20 extends through the wall of the housing 10 into the breathing chamber and has a threaded end portion on a fitting 22 for connecting the valve to a source of pressurized air via a flexible hose (not shown). As best shown in FIG. 2 the valve 20 includes a generally tubular body 24 which is sealably connected to the housing as by a weldment 26.

A valve member 28 is biased by a coil spring 30 against the inner end of the fitting 22 which thus constitutes a valve seat. The valve member 28 has a stem 32 which extends through a central hole 34 in the end wall of the valve body 24 and a nut 36 is threaded onto the distal end of the stem 32.

An annular portion 38 of reduced external diameter protrudes from the inner end of the valve body and is provided with a diametric slot 40 receiving inwardly extending legs 42 on a pair of tines 44 and 46 of an actuator lever 48. The legs 42 are positioned behind a washer 49 and a spacer sleeve 50 which hold the actuator in the assembled condition against the end face 52 of the main valve body portion 20. As is explained more fully hereinafter, as the diaphragm 14 moves into the recess 12 the actuator lever 48 is pivoted in a clockwise direction, as shown in FIG. 1, to move the valve member 28 in an axial direction away from the valve seat.

The valve body 24 is provided with first and second ports 54 and 56 respectively which admit air to the regulator when the valve is open. The port 56 directs a stream of air into the breathing chamber at a location remote from a breathing port 58 which is connected to the mouth of the diver. The other air inlet port 54 emits a stream of air which is deflected by the opposite arcuate wall position of the housing and a baffle or ledge 60 into the breathing port 58. This latter stream or jet of air provides a venturi action which educts air from the breathing chamber and thereby reduces the pressure in the breathing chamber. A one way exhaust valve 62 is provided in the bottom of the housing 10 for exhausting gases to the ambient when the person using the regulator exhales.

In order to control the venturi action in a breathing regulator of this general design, there is provided in accordance with the present invention a secondary valve member or baffle 64 which is disposed over the port 56 when the air inlet valve 20 is closed and which is moved to open the port 56 as the valve is opened. Consequently, when the diver initially inhales and causes the diaphragm 14 to begin to move into the recess and crack the air inlet valve, all of the air from the valve exits through the port 54 to provide a maximum venturi asssist to the diver. However, as the diaphragm continues to move into the recess to further open the valve 20 the port 56 begins to open so that some of the air enters the breathing chamber to offset the venturi effect. FIG. 3 shows the position of the baffle 64 when the air inlet valve is fully closed, and FIG. 4 shows the position of the baffle 64 when the air inlet valve is fully open.

Considered in greater detail, the member 64 is concavo-convex in cross-section as shown in FIG. 5 and is held against the exterior surface of the valve body 24 by a pair of guides 65 and 66 which are brazed or welded to the valve body. An ear-like portion 68 is provided with a slot 69 which receives a rod 70 fixedly connected to the actuator lever 48. As may be seen from an inspection of FIGS. 3 and 4, as the actuator lever 48 is pivoted in a clockwise direction to open the air inlet valve the member 64 is slid to the right away from the air inlet port 56. Similarly, when the diaphragm moves up to permit the actuator lever 48 to be pivoted counterclockwise by the spring 30, the member 64 is moved to the length over the port 56.

In addition to the reduction in venturi effect which is effected by the movement of the member 64 from its position over the port 56, a second baffle member 72 is connected to the actuator lever 48 for movement into the stream of air exiting the port 54 as the air inlet valve member is moved from its fully closed to its fully open position. As best shown in FIGS. 5–7, the baffle 72 is slidably mounted by a pair of guide channels 73 and 74 for movement between the position shown in FIG. 7 and the position shown in FIG. 8. The baffle 72 has a lug portion 76 provided with a vertical slot 77 which slidably receives the rod 70. The baffle 72 also has a semi-conical central section 80 which deflects a major portion of the stream of air from the port 54 into the breathing chamber when the baffle 72 is in the position shown in FIG. 8 with the deflector section 80 disposed partially over the port 54. If desired, the baffle section 80 may be apertured as shown for example, at 82 to enable better control of the venturi effect provided by the regulator.

In the regulator 10, a very substantial change in the venturi effect is achieved by the simultaneous use of the two baffle or valve members 64 and 72. However, in some cases the desired change can be effected by using only one or the other of these members 64 and 72 wherefor the present invention is not limited to the use of only two such baffles.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. Breathing apparatus for use with a source of compressed air, comprising in combination a housing having a recess therein a diaphragm mounted across said recess to define a chamber in said housing, a breathing port opening through said housing into said chamber, an air valve mounted to said housing and having an air inlet for connection to said source of compressed air and an air outlet port disposed to direct a stream of air from said outlet port into said breathing port thereby to develop a venturi action in said regulator by educting air from said chamber, a valve element in said air valve movable between a fully open position and a fully closed position, actuator means connected between said valve element and said diaphragm for moving said valve element between said fully closed and said fully open positions in response to the movement of said diaphragm, baffle means mounted for sliding movement across said outlet port, and means connecting said baffle means to said actuator means whereby said baffle is moved over said port as said valve element is moved toward said fully open position.

2. Breathing apparatus according to claim 1 wherein said air valve includes a body portion disposed in said chamber, and guide means carried by said body portion for guiding said baffle means in its movement across said outlet port.

3. Breathing apparatus according to claim 2 comprising a lost motion connection between said actuator means and said baffle means.

4. Breathing apparatus according to claim 2 wherein said actuator means is pivotally connected to said body portion of said air valve.

5. Breathing apparatus according to claim 1 comprising a second air outlet port form said air valve, said second air outlet port being disposed to direct air into said chamber at a location remote from said breathing port so as to increase the pressure in said chamber, second baffle means mounted for sliding movement across said second air outlet port, and means connecting said second baffle means to said actuator means for moving said second baffle means over said second air outlet port as said valve element is moved into said fully closed position.

6. Breathing apparatus comprising a housing having a recess therein, a diaphragm mounted across said recess to define a chamber in said housing, a breathing port opening into said housing an air valve mounted to said housing and having a first air outlet port for directing air into said breathing port and a second air outlet port for directing air into said chamber, a valve element in said air valve movable between open and closed positions, baffle means movable across said second air outlet port, actuator means interconnected between said diaphragm and said baffle means for moving said baffle means away from said port as said diaphragm moves into said recess, and means interconnected between said diaphragm and said valve element for moving said valve element toward said open position as said diaphragm moves into said recess.

7. Breathing apparatus according to claim 6 wherein said actuator means is pivotally mounted, and a lost motion connection between said actuator means and said baffle means.

8. A method of controlling the venturi action in a breathing regulator of the type having a breathing chamber, a breathing port opening into said chamber, an air control valve having a first air outlet port and a second air outlet port, means responsive to a reduced pressure in said breathing chamber for directing a stream of air from said first outlet port into said breathing port to cause a venturi action which reduces the pressure in said breathing chamber, and means for directing air from said second outlet port into said breathing chamber to increase the pressure in said breathing chamber, comprising varying the ratio of the amount of air directed into said breathing port from said first air outlet to the amount of air directed into said breathing chamber from said second air outlet in relation to the volume of air supplied to said regulator by varying the effective size of said second air outlet port in inverse relationship to the pressure in said breathing chamber relative to the ambient pressure.

9. A breathing regulator for use with a source of compressed air, comprising a housing having a breathing chamber therein, a breathing port opening through said housing into said chamber, air valve means responsive to a reduced pressure in said breathing chamber and having a first air outlet directing a stream of air into said breathing port to provide a venturi action which tends to reduce the pressure in said chamber and a second air outlet for directing air into said chamber which tends to increase the pressure in said chamber, and means responsive to increasing pressure differential between said chamber and the ambient for increasing the effective size of said second air outlet, whereby the relative amounts of air which flow through said air outlets is variable and related to the pressure difference between said chamber and the ambient.

* * * * *

UNITED STATES PATENT AND TRADEMARK OFFICE

CERTIFICATE OF CORRECTION

PATENT NO. : 4,214,580

DATED : July 29, 1980

INVENTOR(S) : Vernon G. Pedersen

It is certified that error appears in the above–identified patent and that said Letters Patent are hereby corrected as shown below:

Column 1, line 58, change "that" to -and-.

Column 3, last line, change "length" to -left-.

Claim 5, line 3, change "form" to -from-.

Signed and Sealed this

*Fourth* Day of *November 1980*

[SEAL]

*Attest:*

SIDNEY A. DIAMOND

*Attesting Officer*

*Commissioner of Patents and Trademarks*